United States Patent [19]

Kleger et al.

[11] Patent Number: 5,076,183

[45] Date of Patent: Dec. 31, 1991

[54] SHUTTLE FOR EMBROIDERY AND QUILTING MACHINES

[75] Inventors: Ferdinand Kleger, Rorschach; Hans Zeller, Rebstein, both of Switzerland

[73] Assignee: Perfecta-Schmid AG, Switzerland

[21] Appl. No.: 608,715

[22] Filed: Nov. 5, 1990

[30] Foreign Application Priority Data

Jun. 13, 1990 [CH] Switzerland ..... 01989/90

[51] Int. Cl.[5] ..... D05B 57/10

[52] U.S. Cl. ..... 112/234; 112/233

[58] Field of Search ..... 112/117, 195, 232, 233, 112/234

[56] References Cited

U.S. PATENT DOCUMENTS

| | | | |
|---|---|---|---|
| 156,933 | 11/1874 | Mangus | 112/234 |
| 178,431 | 6/1876 | Graff | 112/233 |
| 180,541 | 8/1876 | Butcher | 112/233 X |
| 184,366 | 11/1876 | Gillett | 112/234 |
| 198,693 | 12/1877 | Schumacher | 112/233 X |
| 222,930 | 12/1879 | Mullikin | 112/233 |
| 285,418 | 9/1885 | Leavitt | 112/234 |
| 321,381 | 6/1885 | Osborn | 112/234 |
| 3,253,558 | 5/1966 | Hagen | 112/234 X |

FOREIGN PATENT DOCUMENTS

| | | | |
|---|---|---|---|
| 0105121 | 8/1899 | Fed. Rep. of Germany | 112/234 |
| 0004138 | of 1877 | United Kingdom | 112/234 |
| 0004195 | of 1877 | United Kingdom | 112/234 |

*Primary Examiner*—Werner H. Schroeder
*Assistant Examiner*—Ismael Izaguirre
*Attorney, Agent, or Firm*—Speckman & Pauley

[57] ABSTRACT

The embrodiery machine shuttle, preferably made of plastic, has two main components, namely a base plate and a housing which can be fastened on the base plate. The base plate forms the slide face of the shuttle. For this reason the elements required for thread tension are placed in the interior of the shuttle. A bobbin is maintained in the correct position by a bobbin mounting and a part thereof forms a rear thread guide element. The thread is drawn off the bobbin and routed to a thread hole through and around the thread guide element between an upper pressure plate and a lower counterpressure spring. The thread tension can be easily adjusted from the outside with a slide. The shuttle according to the present invention is suited, together with a corresponding shuttle processing machine, for automatic emptying, cleaning, filling with a fresh bobbin, threading and setting the thread tension.

13 Claims, 4 Drawing Sheets

SHUTTLE FOR EMBROIDERY AND QUILTING MACHINES

FIELD OF THE INVENTION

The present invention relates to a shuttle, preferably of plastic, for embroidery and quilting machines and includes a housing and a base plate, which can be connected therewith, on which a thread tension device is positioned which adjusts the thread tension.

BACKGROUND OF THE INVENTION

Shuttles for embroidery and quilting machines, used all over the world today, are preferably made of steel and only approximately 10% of plastic. The average age of a shuttle is 12 to 15 years. But shuttles which have been used for 30 or more years are not uncommon. As a result, shuttles of various ages are used in an embroidery machine, which have certain differences with respect to the mass at the shuttle hole and of the cover, or where the cover itself has been changed. For this reason all efforts to automate the emptying, cleaning, re-filling and setting if the thread tension of current shuttles have failed. Although attempts have been made within the past ten years to change certain operations of these steps into separate automated operations, such attempts have been only moderately successful. All shuttles need to be identical for automation and they must be newly designed for handling by machine.

SUMMARY OF THE INVENTION

It is therefore an object of the present invention to develop a novel shuttle for embroidery and quilting machines, which can be fully and automatically emptied, cleaned, filled and threaded again as well as in which the thread tension can be adjusted exactly. It is a further object of the present invention to be able to manufacture the shuttle considerably more economically than conventional shuttles. Conversion of embroidery machines to the new shuttles is only economical for the embroidery industry under the last mentioned conditions. Acquiring the new shuttles alone is not enough. Appropriate bobbin winding machines and shuttle processing machines, in which the shuttles are emptied, cleaned, the bobbins inserted, the threads threaded, the thread tension set, the shuttles inserted into an insertion guide and finally the insertion guides placed on a transport carriage, are all automated. But for full automation, appropriate transport devices and devices for removing and replacing the shuttles in the embroidery and quilting machine are also required. But the key to the entire, fully automatic operation is the shuttle. Of particular importance for the automation in this case is a simplified exterior design of the shuttle. This is achieved in accordance with the present invention when the base plate forms at least a portion of the glide face of the shuttle and when the means which are part of the thread tension device are located on the base plate in the interior of the shuttle.

Further characteristics in accordance with the present invention are set forth in the dependent claims which are described as to their meaning and purpose in the description below. Three preferred embodiments of the subject of the invention are shown in the drawings.

DESCRIPTION OF THE PREFERRED EMBODIMENTS

Figure 1:
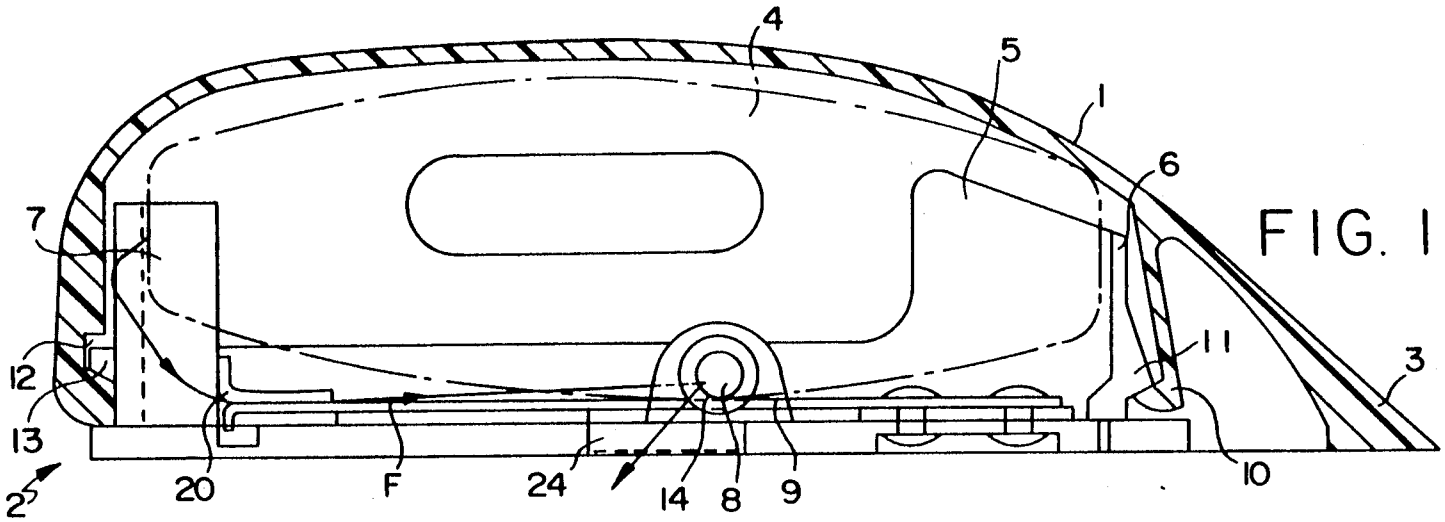
FIG. 1 is a longitudinal cross section of a shuttle in accordance with the invention, in which the entire base plate can be removed from the housing.

The terminology in this specification has been intentionally changed in contrast to the known embroidery machine shuttles. Thus, such terminology alteration is also intended to make clear the completely different design of the shuttle. The embroidery machines which have remained essentially the same for more than 100 years customarily have a shuttle body which receives a bobbin and a cover, which is pivotal in the shuttle body around an axis extending crosswise to the longitudinal axis, by means of which the bobbin is retained in the shuttle body. In this case, the edge of the shuttle body represents the glide face. The pivotal cover is offset towards the interior with respect to this glide face. It has a thread tensioning spring on its exterior, for example directed towards the slide face, on which a tensioning clip acts, by which the thread tension can be set. The thread is pulled off the bobbin, run to the outside through the cover, under the tensioning spring back inside through the cover and then laterally outside through the hole in the shuttle body. Reference is made to Austrian Patent AT-A-61077, purely by means of example. Presently, all embroidery machine shuttles have this design.

In connection with the embroidery machine shuttle according to the present invention, the part which has so far been called "shuttle body" will now be called the housing. The part formerly called "cover" will now be called base plate 2. This for the additional reason that the base plate 2 not only has a closing function but, in contrast to the known objects, at least partially forms the glide face of the shuttle. This considerably increased support face in the direction of the shuttle race, instead of the almost sharp edge of a conventional shuttle, together with the use of a certain plastic, metal or steel alloy, results in optimum sliding properties. Damage to the shuttle race is practically impossible, because the point of the shuttle is always supposed to be made of plastic. Now the bobbin 4 n longer lies inside the shuttle body to a large degree, but rather on the base plate 2, which is appropriately equipped with bobbin mounting attachments. The shuttle housing now has the cover function which had previously been assigned to the cover. The former terminology is subsequently no longer used, and also no comparisons with the shuttles in accordance with the known state of the art can be made.

The embroidery machine shuttle in accordance with the present invention is essentially made of plastic. It has the already mentioned main components, namely the housing 1 and the base plate 2. Only in the area of the shuttle point 3 does a part of the housing 1 also form a part of the glide face. Otherwise, the base plate 2 takes over this function, as can be clearly seen in FIG. 1. The bobbin 4, shown in the drawings by a dotted line, lies on the base plate 2 and its position is determined by a bobbin mounting 5. In the direction towards the point, the position of the bobbin 4 is defined by the front mounting plate 6. The mounting plate 6 is a part of the bobbin mounting 5, which can be fixedly connected with the base plate 2 or can be integral with the base plate 2. At the back end of the shuttle, the bobbin mounting 5 changes over into a rear thread guide element 7.

The thread F, pulled off the bobbin 4, is drawn through a slit ending in a thread guide opening and runs around the rear thread guide element 7, which is appropriately arc-shaped, to the thread tension device which is described below.

The thread F leaves the chamber in which the bobbin 4 is seated directly through the lateral thread hole 8. The thread hole 8 is embedded in a bracket 9 extending vertically to the base plate 2 on its side. The thread hole 8 has a metal o ceramic coating to improve the running or frictional properties, in the present embodiment in the shape of an impressed eye 14 of metal or ceramic material. The housing 1 is mounted on the base plate 2 in a form-fitting and frictional manner. To facilitate such mounting, a flexible stop cam 10 is extruded from the interior of the housing in the area of the shuttle tip 3, which lockingly engages a projection 11 on the mounting plate 6. A corresponding form-fitting receptacle 12 is embedded in the rear wall of the housing 1. In the closed operational state of the shuttle, the conventional cam 13 on the thread guide element 7 rests in the form-fitting receptacle 12.

In the area between the rear thread guide element 7 and the thread hole 8, the thread F is routed through a thread tension device. The thread tension device comprises an upper pressure plate 20 fastened on the base plate 2, directly following the thread guide element, crosswise to the longitudinal direction of the shuttle. The upper pressure plate 20 is fastened with rivets 21. The upper pressure plate 20 is drawn upwards in an arched shape in the direction towards the shuttle end. A lower counterpressure spring 22 is fastened with two rivets 23 in the forward area of the base plate 2. The lower counterpressure spring 22 extends over almost the entire length of the base plate 2. With its free end the lower counterpressure spring 22 abuts below, under spring pressure on the upper pressure plate 20. The free end of the lower counterpressure spring 22 is downwardly curved. Rounding of the upper pressure plate 20 and the lower counterpressure spring 22 in the area where the thread F enters the thread tension device is required so that no unraveling twist acts on the thread, which might result in knot formation and breaking of the thread. The flat clamping of the thread F between the upper pressure plate 2 and the lower counterpressure spring 22 can be regulated by a slide 24. The slide 24 presses on the lower counterpressure spring 22 from below. The closer the slide 24 is pushed in the direction of the upper pressure plate 20, for example in the direction towards the back end of the shuttle, the greater is the clamping force between the pressure plate 20 and the counterpressure spring 22. As the clamping force increases, the set thread tension increases. The slide 24 is slidingly maintained in a slide guide 25 embedded in the base plate 2. It is possible to displace the slide 24 within the area of the slide guide 25 from the direction of the underside of the base plate 2. Such a thread tension device is particularly suited to automatically set the thread tension to a reproducible value in a suitably constructed device.

So that the slide 24, because of the intense back and forth movements of the shuttle, in particular at high speed, does not shift by itself because of these dynamic forces, it is possible to press into the base plate 2 a delicate grid, so that the slide 24 remains in the desired position. This grid, preferably made of a plurality of parallel grooves vertically to the direction the slide guide 25 extends, is provided on the inside of the base plate 2 and the lower counterpressure spring 22 keeps the slide 25 engaged with the grid.

Figure 2:
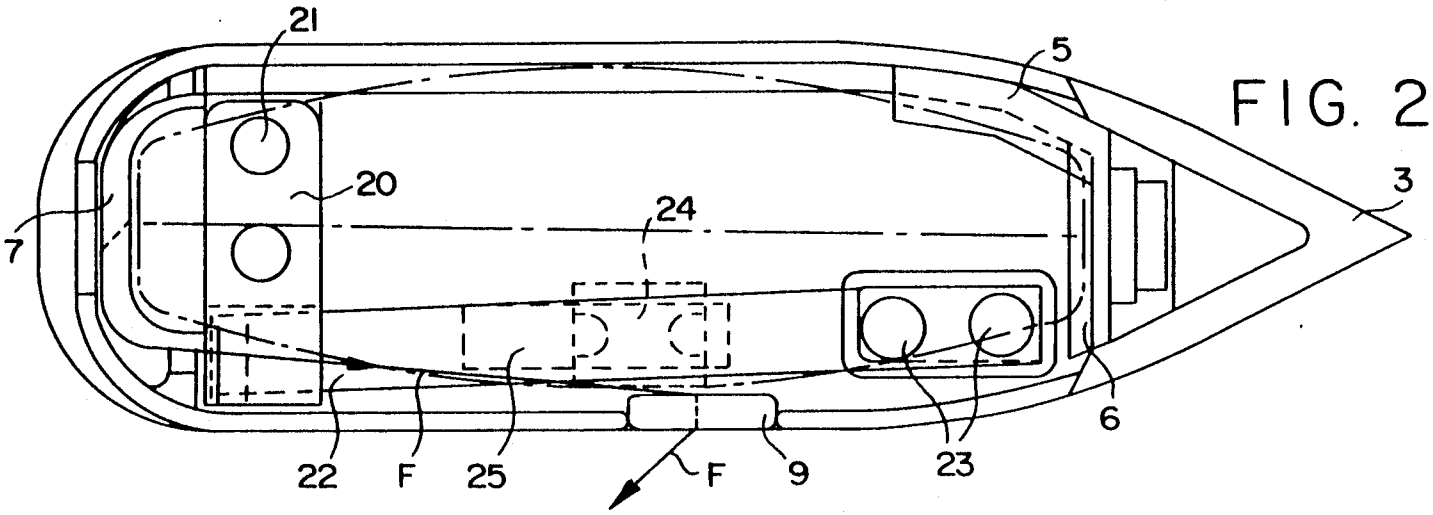
FIG. 2 is a bottom view of the shuttle in accordance with FIG. 1.

The embodiment shown in FIGS. 1 and 2 is based on a complete separation of the base plate 2 and the housing 1 when a fresh bobbin 4 is inserted. Such a method has the advantage that the main components can be cleaned in a particularly easy manner and that one or the other component can be immediately replaced in case of a defect, without assembly operations being required for this. In case of destruction of the sensitive shuttle point 3 of the housing 1, in particular, the housing 1 can be replaced immediately, because all shuttle housings 1 and base plates 2 are identical.

No further mention is made of the already described and only minimally changed parts of the shuttle in the two embodiments in accordance with FIGS. 3 to 5 and 6 to 9, which will be described below. Identical parts have been assigned identical reference numerals to the extent that the need to be at all mentioned.

Figure 3:
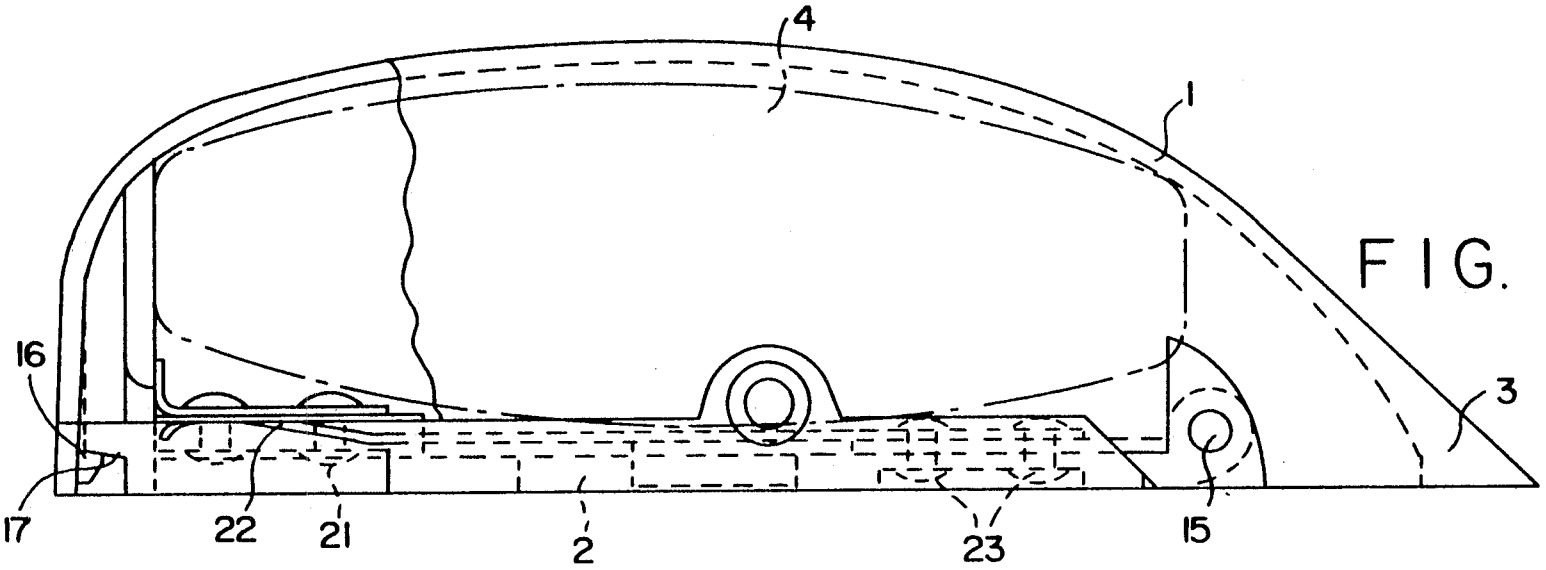
FIG. 3 is a longitudinal cross section through a shuttle wherein the base plate is pivotally connected with the housing around an axis provided in the area of the tip, crosswise to the longitudinal direction.
Figure 4:
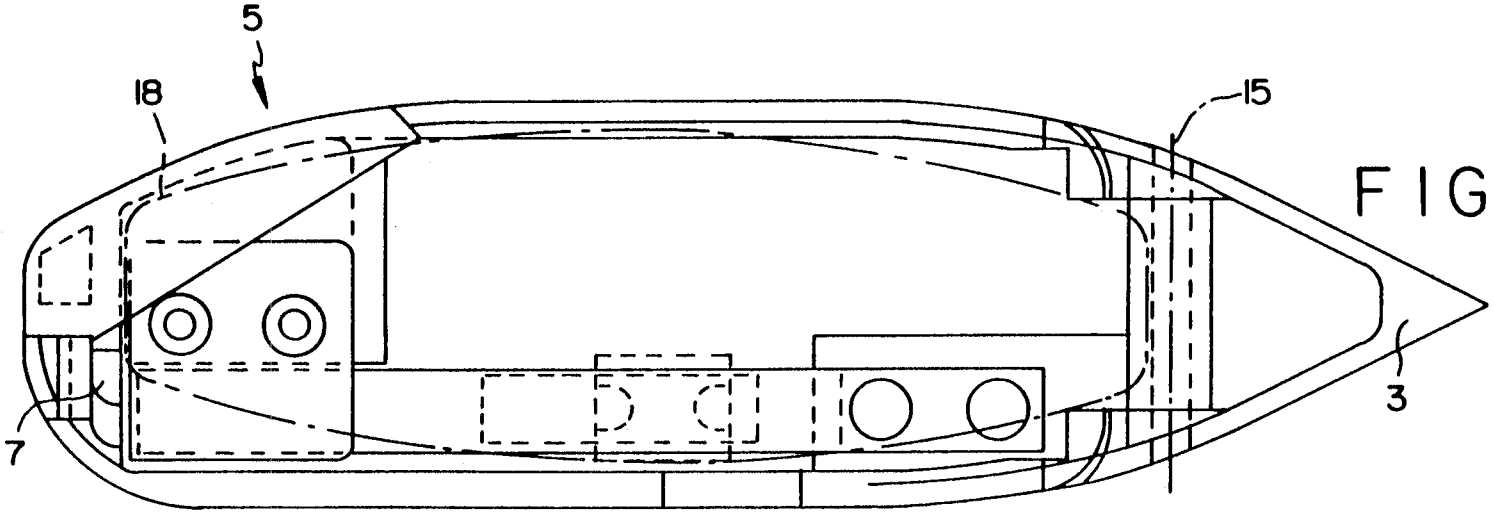
FIG. 4 is a bottom view of the shuttle in accordance with FIG. 3, in the closed position.
Figure 6:
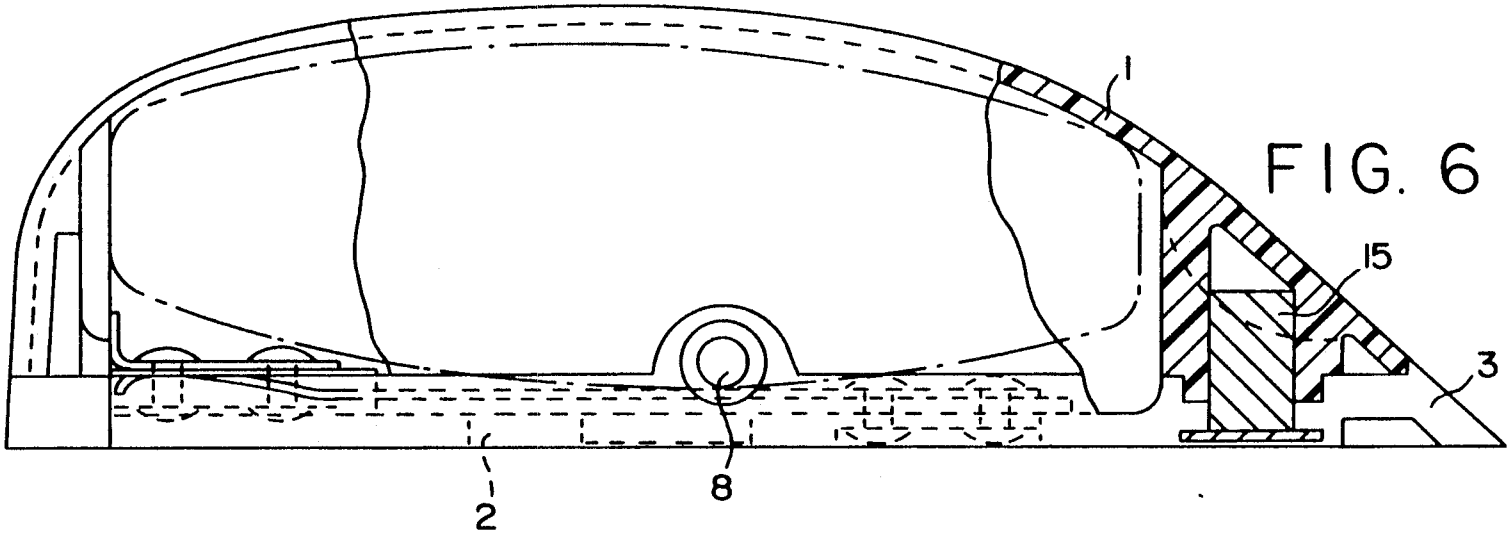
FIG. 6 is another embodiment of a shuttle in longitudinal cross section, wherein the base plate is pivotally connected with the housing around an axis positioned vertically to it in the tip of the shuttle.
Figure 7:
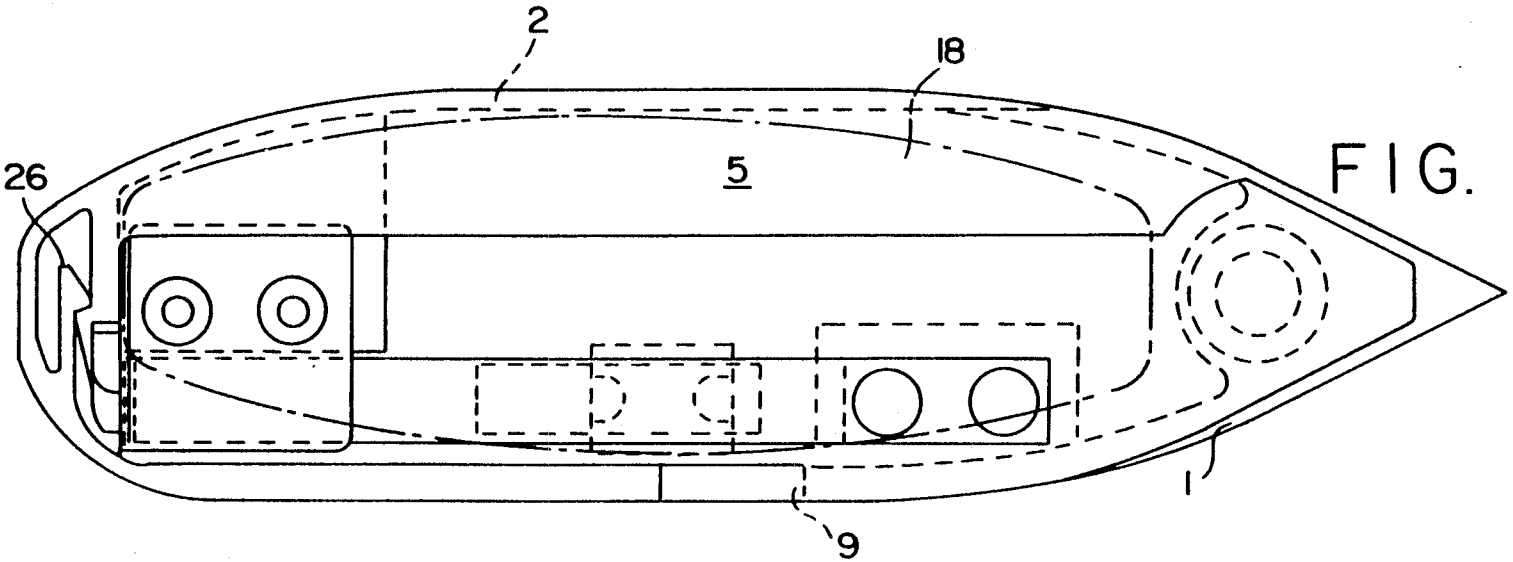
FIG. 7 is a bottom view of the shuttle in accordance with FIG. 6.
Figure 8:
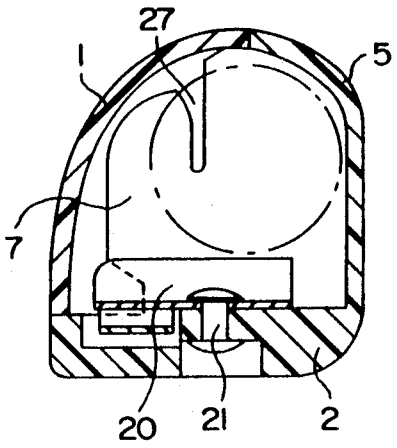
FIG. 8 is a cross section of the shuttle in accordance with FIG. 7 in the area of thread tensioning.
Figure 5:
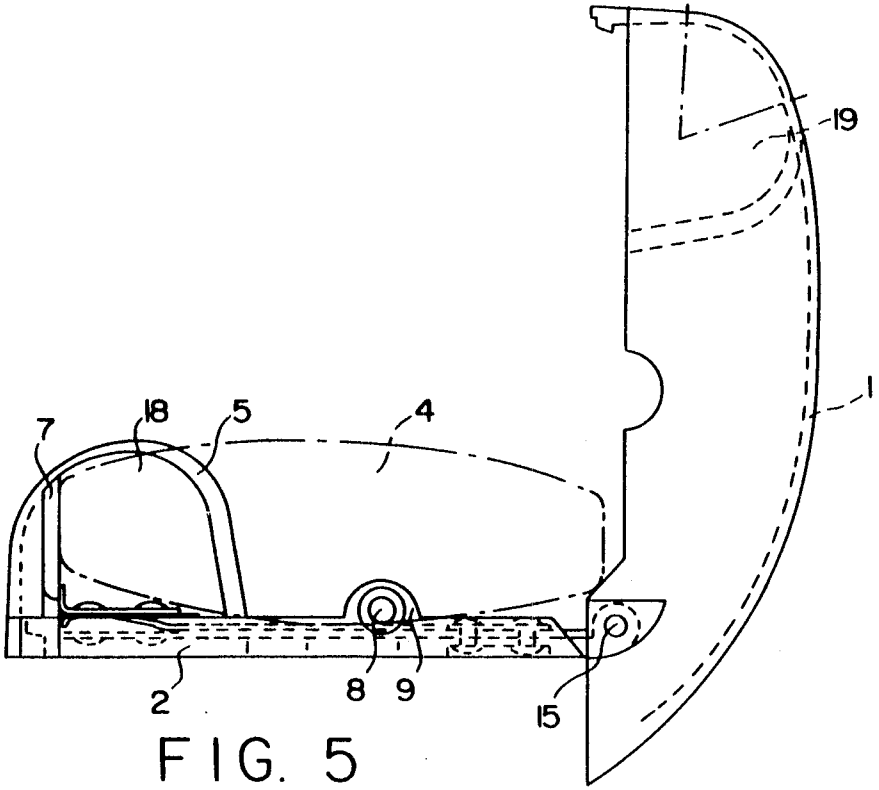
FIG. 5 is a side view in the opened position.

The essential characteristic of the embodiment of the shuttle of the present invention in accordance with FIGS. 3 to 5 lies in that the base plate 2 is pivotally seated in the housing 1 on a horizontal pivot axis 15. The pivot axis 15 extends parallel to the base plate 2 as well as vertically to the longitudinal axis of the shuttle. The part of the housing 1 which forms the point 3 of the shuttle is drawn down as far as the lower level of the base plate 2. In this way the front part of the housing 1 forms a portion of the slide face of the embroidery machine shuttle. Thus, the connection between the housing 1 and the base plate 2 in the area of the shuttle point 3 by the pivot axis 15 is permanent in this embodiment and a locking mechanism is only needed at the end of the shuttle. In the example shown, a stop cam 16 is provided on the inside of the housing 1, over which the end of the base plate 2 locks, so that the cam 16 comes to rest in a recess 17 in the base plate 2. A part of the bobbin mounting 5 and of the rear thread guide element 7, together with the base plate 2, form a unit. For this purpose a housing area 18 has been taken over by the base plate 2, for which reason the housing 1 itself has a corresponding housing recess 19 of the same size. This is particularly clear in FIG. 5, which shows the shuttle of the invention in an opened state. The further elements are the same as in the embodiment in accordance with FIGS. 1 and 2, as previously described. No further mention will be made of this.

Figure 9:
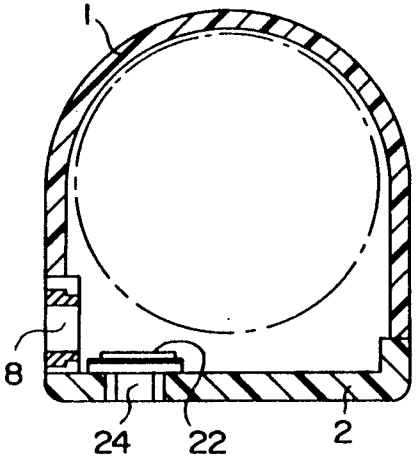
FIG. 9 is a cross section of the shuttle in accordance with FIG. 7 in the area of the thread exit opening.

Another embodiment of the embroidery machine shuttle in accordance with the present invention is illustrated in FIGS. 6 to 9. In contrast to the previously described embodiments, the housing 1 and the base plate 2 are connected rotatably with respect to each other on a vertical pivot axis 15, again in the area of the shuttle tip 3. In this embodiment, the actual shuttle point 3 is formed by the base plate 2. In this embodiment, the bobbin mounting 5 extends almost completely over the entire length of the shuttle and forms a housing area 18 directly disposed on the base plate 2. When opening the shuttle there is an apparent displacement in the longitudinal direction. However, actually only a displacement of the housing 1 on the pivot axis 15 takes place. Only because the bobbin mounting 5 also includes a relatively larger housing area 18 does this apparent longitudinal division of the shuttle take place. It can be seen from FIG. 8, which represents a cross section of the shuttle in accordance with FIG. 7 in the area of the rear thread guide element 7, the base plate 2 together with the bobbin mounting 5 represent almost two-thirds of the circumference of the shuttle, while in this area the housing 1 only represents one-third. The housing 1 is mounted on the base plate 2 in a form-fitting manner with flexible stop cam 26 engaging with a projection of base plate 2. The rear thread guide element 7, clearly discernible here, is simultaneously a stop plate for the bobbin 4 and has a thread guide slit 27. The latter extends downward vertically to the base plate 2 as far as approximately half the height of the bobbin 4. The thread which is pulled off the bobbin 4 is routed through the thread guide slit 27 towards the back and around the thread guidance element 7 towards the front, passing the thread tension device 20, 22 and leaving the shuttle through the thread hole 8. FIG. 9, which represents a cross section through the shuttle in the area of the thread hole 8, clarifies such routing. This is at the same time the area of the largest cross section. The slide 24 can be seen here clearly as it presses from below against the lower counterpressure spring 22.

Because the housing 1 can be made of plastic, the shuttles in accordance with the present invention may also have considerably more complex exterior shapes, as shown by the embodiments in accordance with FIGS. 3 to 9. The asymmetric shape of the housing 1 with respect to its longitudinal axis is particularly noticeable. Thus the rear part of the shuttle becomes more slender. The cross sectional surface in particular is reduced steadily, approximately from the end area of the slide guide 25 and extending towards the end, for example the circumference is reduced only in the last third or at least fourth of the shuttle. In contrast to conventional shuttles, this results in a reduction of the draw of the needle thread and in an extension of the time during which the thread guide can pull back the thread.

For the purpose of clarification, the mode of operation of the embroidery machine is briefly addressed.

It is the job of the shuttle to pass through the loop of the needle thread with its point, so that the front thread is kept on the backside of the material. To this end the shuttle is pushed forward at the exact time when the needle again arrives at its culmination point after a short reverse movement. The shuttle passes with its point through the loop created by the reverse movement. By the time the needle has arrived at its front reversing point, approximately half of the shuttle has already passed through this loop. Starting from the middle of the shuttle, the needle already moves backwards. During this backward movement the shuttle continues to be pushed through the loop. Due to the novel shape of the shuttle, where the rear part of the shuttle is more slender or has a smaller circumference, less thread, which must always be pulled back by the thread guides, is drawn out with each stitch.

In the course of practical application this means that with the new construction the front thread is pulled back and forth to a lesser degree through the material, which demonstrably leads to a reduced frequency of needle thread breakage.

Since this is a completely new generation of embroidery machine shuttles, it is not possible to illustrate all conceivable embodiments. However, the essential and basic principle of the present invention is that the shuttle no longer runs on the edge of its housing as before, but rather on its base plate 2, which also takes over the function of the previous cover.

We claim:

1. A shuttle for embroidery and quilting machines having a housing and a base plate connectable therewith, and a thread tension device for adjusting a thread tension, the improvement comprising: the base plate (2) forming at least a part of a slide face of the shuttle and the thread tension device (20 to 25) being disposed on the base plate (2) in an interior of the shuttle;

a bobbin mounting (5, 6) and means for thread guidance (7, 8) positioned on the base plate (2); and said bobbin mounting including a support wall (7) positioned in a rear area of the shuttle, and said support wall (7) having a thread guidance slit (27).

2. A shuttle in accordance with claim 1, wherein the base plate (2) is pivotally (15) connected to the housing (1).

3. A shuttle in accordance with claim 2, wherein the base plate (2) is pivotal with respect to an axis (15) extending vertically to the base plate (2).

4. A shuttle in accordance with claim 2, wherein the base plate (2) is pivotal with respect to an axis (15) extending parallel to the base plate (2).

5. A shuttle in accordance with claim 1, wherein the thread tension device comprises an upper pressure plate (20) fastened in an end area of the shuttle, and a lower counter pressure spring (22) fastened in a front half of the shuttle and biased against said upper pressure plate (20), and a slide (24) in the base plate (2) which abuts from below against the counterpressure spring (22) and is slidingly seated below in a guide (15) between a fastener (21) of the upper pressure plate (20) and the lower counterpressure spring (22).

6. A shuttle in accordance with claim 5, wherein said slide (24) is slidingly seated in a guide (25) embedded into the base plate (2) and offset in a direction towards a back end of the shuttle.

7. A shuttle in accordance with claim 6, wherein said slide (24) is actuated from said slide face outside of the shuttle.

8. A shuttle in accordance with claim 5, wherein said slide (24) and the base plate (2) are formed with a grid such that said slide (24) engages in a pre-determined position and prevents displacement of said slide (24) in the course of a back and forth movement of the shuttle.

9. A shuttle in accordance with claim 1, wherein a portion (18) of the housing (1) is integral with the base plate (2).

10. A shuttle in accordance with claim 1, wherein one side of the base plate (2) forms a bracket (9) in an area of the housing (1) having a thread hole (8).

11. A shuttle in accordance with claim 10, wherein said thread hole (8) is coated with a metal or a ceramic material.

12. A shuttle in accordance with claim 1, wherein at least the shuttle housing is asymmetric with respect to the longitudinal axis resulting in a reduction of a cross-sectional surface at least in a last quarter portion of the shuttle.

13. A shuttle in accordance with claim 1, wherein the base plate (2) and the housing (1) are plugged (10, 11, 12, 13) into each other.

* * * * *